United States Patent [19]

Hall et al.

[11] Patent Number: 4,867,090

[45] Date of Patent: Sep. 19, 1989

[54] FORWARD DECK CONSTRUCTION FOR A SWATH OR CATAMARAN-TYPE VESSEL

[75] Inventors: Nelson W. Hall, Doway; Gregory Smith, San Diego, both of Calif.

[73] Assignee: Swath Ocean Systems, Inc., Ranch Santa Fe, Calif.

[21] Appl. No.: 173,976

[22] Filed: Mar. 29, 1988

[51] Int. Cl.[4] ..... B63B 13/00

[52] U.S. Cl. ..... 114/61; 114/85; 114/182

[58] Field of Search ..... 114/61, 85, 261, 262, 114/343, 364, 182

[56] References Cited

U.S. PATENT DOCUMENTS 1,914,573 6/1933 KooKogey ..... 114/85
4,543,898 10/1985 Castilla ..... 114/61

FOREIGN PATENT DOCUMENTS 559619 2/1944 United Kingdom ..... 114/61

*Primary Examiner*—Joseph F. Peters, Jr.
*Assistant Examiner*—Edwin L. Swinehart
*Attorney, Agent, or Firm*—Charles E. Townsend, Jr.

[57] ABSTRACT

The forward deck of a swath or catamaran type vessel is constructed largely of a sieve-type material, such as honeycomb-type deck grating. Should the foredeck of the vessel, which is normally suspended above the water line become submerged by plowing into a wave, or otherwise inundated by large masses of green water which would otherwise tend to weight the bow of the vessel down, the above deck water will simply drain through the sieve-type material and permit the inherent flotation of the pontoons and hull of the vessel to promptly raise the bow to relative horizontal position.

2 Claims, 1 Drawing Sheet

FORWARD DECK CONSTRUCTION FOR A SWATH OR CATAMARAN-TYPE VESSEL

BACKGROUND OF THE INVENTION

1. Field of the Invention

This invention relates to a new and improved swath or catamaran type vessel, and more particularly to a new and improved forward deck construction for the above water superstructure for such vessel.

2. Description of the Related Art

The term "swath" is an acronym for Small Waterplane Area Twin Hull. Conceptually, these types of vessels date back to the last century and are characterized generally as comprising two submerged parallel propulsion torpedo-like pontoons, each of which is provided with one or more vertical struts which project upwardly a substantial distance above the water line and which at their upper ends support the entire superstructure of the vessel. In general, the combined buoyancy of the two (or more) propulsion pontoons is sufficient to support the superstructure of the vessel a predetermined distance (e.g., 5–8 feet) above water level while the boat is at rest as well as when it is under way in relatively calm waters. It is well known to provide swath vessels with underwater horizontal stabilizers or canards to assist in maintaining stability of the boat in terms of pitch, roll or yaw while moving at medium to higher speeds either calm water or rough waters.

The above water superstructure of a swath may be designed and outfitted to function in all substantial respects as a conventional mono-hull boat or ship, either primarily as a cargo or passenger carrying vessel. During more recent years, a number of passenger carrying swath vessels ranging in length from around 60 feet to over 200 feet have been built and tested or operated as ocean or seagoing vessels with reasonable success.

To our present knowledge, all of the reasonably well designed swaths that have been built and operated within the past decade provide much enhanced riding stability over any known conventional hull or catamaran construction. A properly designed swath inherently provides a much more "level" ride as far as minimizing the amount of pitch and roll inherent in more conventional designs. However, one severe shortcoming that has been encountered by certain swath vessels is that when the vessel at relatively high speed encounters even moderately rough head seas (involving as little as 10 foot seas) the bow of the swath super-structure tends to plough into the oncoming waves and become submerged in green water, creating the danger of swamping and even sinking of the vessel.

In the conventional boat deck construction, including mono-hulls, catamarans and more conventional swath vessels, the decking itself is made of impervious planking or other form of decking material. Means for draining excess water from deck surfaces are conventionally provided by rain scuppers and green water freeing ports. These side ports or water drains function effectively to drain off rain water and fair amounts of green water even on swath and catamaran vessels. However, if and when the foredeck of the such a vessel becomes submerged under a cresting wave or becomes totally inundated by green water, the side openings of the scuppers and freeing ports are almost useless in giving prompt relief from the weight of the inundating water exerting downward pressures on the foredeck and bow. The inherent buoyancy of the vessel to upright itself within safe time limitations is greatly inhibited. In one instance of which we are aware, the foredeck of a swath vessel submerged by plowing into a oncoming wave at high speed had to be extricated by reversing the engines and literally backing the vessel out from under the mountain of water weighting down the foredeck at a dangerously pitched angle.

SUMMARY OF THE INVENTION

An object of the present invention is to construct the forward deck portion of a swath or catamaran vessel superstructure in such manner that should it become submerged by virtue of plowing into an oncoming wave, or should the deck take on very large amounts of green water, the foredeck will, in effect, act like a sieve in permitting the great bulk of the water to travel or drain right through the foredeck and alleviate the danger of water weighting down and keeping the bow dangerously submerged.

A more particular object of the invention is to construct at a relatively expansive foredeck of a swath or catamaran superstructure utilizing an open cell floor grating or grid over a large percentage of the total deck area in lieu of more conventional impervious planking or solid reinforced plastic decking conventional to all types of boats and ships.

Other objects and advantages of the present invention will become apparent upon reading the following specification and referring to the accompanying drawings in which corresponding parts are similarly numbered in each of the several view and wherein:

DETAILED DESCRIPTION OF PREFERRED EMBODIMENTS

Figure 1:
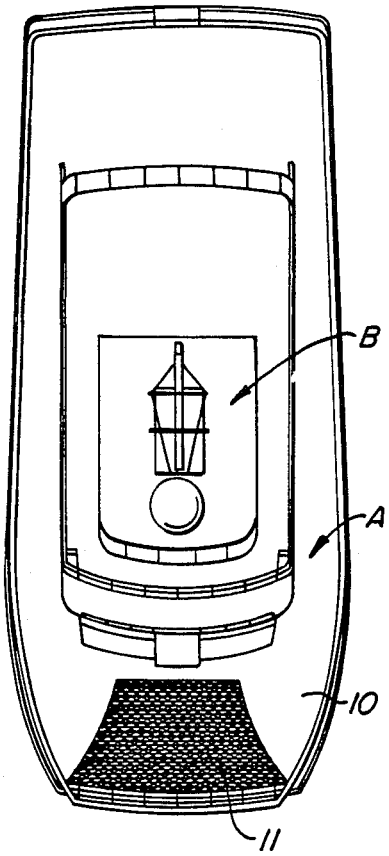
FIG. 1 is a front elevational schematic outline of a swath vessel showing certain portions of the foredeck cut away to expose the grating segment and supporting structure therefor.

Referring now more particularly to the drawings, FIG. 1 shows the upper, above water superstructure of a swath vessel and which schematically shows a fairly expansive deck area indicated generally at A on which is mounted the passenger and pilot cabin structure indicated generally at B. The forward deck portion 10, which is generally that portion of the deck that is located forward of the cabin structures B, is constructed to comprise a relatively large section made from some type of sieve like material 11.

Figure 2:
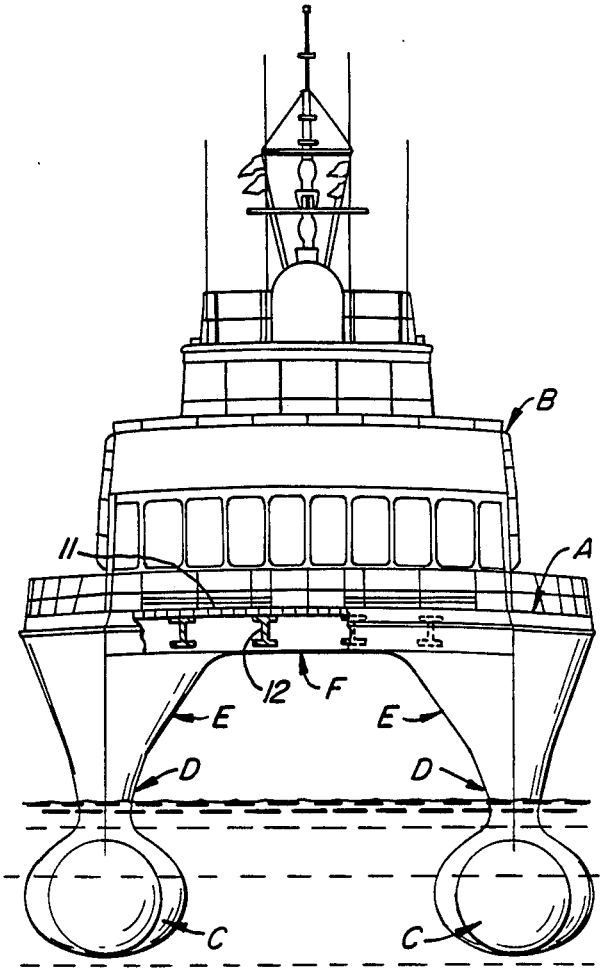
FIG. 2 is a schematic top plan view of a swath vessel, and disclosing by cross hatching a large segment of the foredeck being constructed of conventional open cell floor grating.

FIG. 2 shows, in addition to the deck and cabin structures A and B, respectively, the propulsion pontoons C, vertical struts D, reserve sponsons E and wet bottom F of the swath vessel depicted.

As is conventional with swath vessels, the propulsion pontoons C are normally provided with sufficient buoyancy to support the entire superstructure of the vessel at some predetermined height above normal water line level even when the vessel is at rest.

FIG. 2 further discloses a cut-away portion of the foredeck whereby the decking grid 11 is exposed, in addition to conventional support structures for said decking in the nature of I-beams 12, for example.

Figure 3:
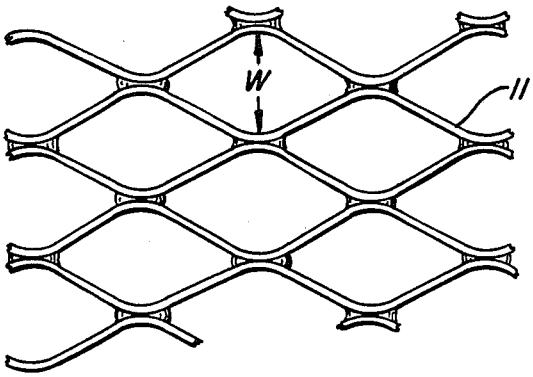
FIG. 3 is an enlarged fragmentary top plan view of a conventional type of walkway or deck grating suitable for the practice of the present invention.

FIG. 3 is an enlarged fragmentary top plan of suitable conventional floor deck grating which may be made of welded or rivoted aluminum or corrosion resistant treated steel. If the ship's hull be made of steel, it is advisable to alleviate galvanic action in the presence of sea water by making the grid from steel, whereas the opposite would be true in case of an aluminum hull.

We have found that a conventional honeycomb or grid-type grating having a nominal cell opening dimension W of around 3" and an overall thickness dimension of perhaps 1½" makes a very satisfactory perforate or sieve-type decking. Such a decking permits pedestrian foot traffic throughout the entire foredeck area. Preferably as much as two-thirds of the entire foredeck area is made of grating to virtually prevent any accumulation of water thereon and to offer little resistance to promptly pass sea water through the deck should the same become submerged under a wave or the like. Significant improvement of deck perviousness can be accomplished by making the foredeck with around only 30% of the area made of open sieve or grating material.

In operation, should the foredeck of a swath or catamaran plow into an oncoming wave, the inherent buoyancy of the pontoons and hull tending to lift the bow back to horizontal will not be unduly impeded or prohibited by the weight of water on and above the submerged foredeck simply because the bow can rise with the water flowing straight through the large gridded area 11 thereof. Similarly, in high seas, should cresting waves inundate the foredeck with large amounts of green water, the grating 11 will again permit almost immediate deck drainage directly through the decking without weighting the bow down, or sloshing around from side to side on top of the decking to cause dangerous instability.

Although the present invention has been described in some detail by way of illustration and example, it is understood that of the invention is limited only by the following claims and equivalents thereof.

What is claimed is:

1. In a swath (small waterplane area twin hull) vessel of a type having the forward deck of its superstructure normally supported above the water line by the buoyancy of the vessel's totally submerged pontoons and associated upwardly extending struts, the combination comprising:

the length of the vessel combined with the flotation characteristics and construction of the underwater pontoons being such as to allow the bow of the vessel to at least occasionally plough into oncoming waves so as to submerge and inundate said bow in green water;

the said normally above water superstructure including a relatively flat and spacious forward deck area;

at least about 30% of the deck area being constructed of a rigid, open cell, pedestrian walkway type grating having sufficient rigidity and structural strength to accommodate normal pedestrian traffic, whereby inundating water above deck can flow directly through said material and permit buoyancy forces of the vessel to promptly raise the bow and said forward deck to above the water line.

2. The combination of claim 1 and wherein more than 50% of the forward deck area of said superstructure is constructed from said open cell pedestrian walkway type grating.

* * * * *